US005873337A

United States Patent [19]

Binford

[11] Patent Number: 5,873,337

[45] Date of Patent: Feb. 23, 1999

[54] IN-GUIDE VALVE STEM SEAL

[75] Inventor: John D. Binford, Richmond, Ind.

[73] Assignee: Dana Corporation, Toledo, Ohio

[21] Appl. No.: 905,456

[22] Filed: Aug. 4, 1997

[51] Int. Cl.[6] ..... F01L 3/08

[52] U.S. Cl. ..... 123/90.37; 123/188.6; 123/188.9; 251/214; 277/502; 277/551

[58] Field of Search ..... 123/90.37, 188.6, 123/188.9; 251/214; 277/502, 511, 551, 560, 572, 313

[56] References Cited

U.S. PATENT DOCUMENTS

| | | | |
|---|---|---|---|
| 3,265,052 | 8/1966 | Goloff | 123/188.9 |
| 3,577,972 | 5/1971 | Moray | 123/188.6 |
| 3,809,046 | 5/1974 | Kammeraad | 123/188.9 |
| 3,885,546 | 5/1975 | Foley et al. | 123/90.37 |
| 4,427,206 | 1/1984 | Sugiyama | 277/572 |
| 4,531,483 | 7/1985 | Vossieck et al. | 123/188.6 |
| 4,660,839 | 4/1987 | Mitumaru | 277/572 |
| 4,773,363 | 9/1988 | Stritzke | 123/188.6 |
| 5,063,397 | 11/1991 | Larson | 123/188.6 |
| 5,385,351 | 1/1995 | White | 277/572 |
| 5,460,139 | 10/1995 | Marlin et al. | 123/188.3 |
| 5,466,084 | 11/1995 | Brueggen et al. | 403/134 |
| 5,476,270 | 12/1995 | Vom Schwemm et al. | 277/551 |
| 5,553,869 | 9/1996 | Stamback | 277/33 |

*Primary Examiner*—Weilun Lo
*Attorney, Agent, or Firm*—Rader, Fishman & Grauer PLLC

[57] ABSTRACT

A two-piece valve stem guide allows the guide to be reamed in-place without damaging an installed valve seal. A first section of the guide is press fitted into an axially extending bore of an internal combustion engine component. Next, a multi-piece seal comprising a metallic retainer, elastomeric seal element and optional spring is inserted into the bore. Then a second section of the stem guide is partially installed into the bore. The two sections are reamed to create a common inner radial diameter that is adapted to receive a valve stem. Finally, the second section is pressed axially downward, engaging the seal and forcing the elastomeric seal element radially inwardly until it comes into contact with an installed valve stem.

13 Claims, 1 Drawing Sheet

IN-GUIDE VALVE STEM SEAL

FIELD OF THE INVENTION

The present invention relates to internal combustion engine valve seals and more specifically to a two piece valve stem guide which allows the guide to be reamed in place without damaging the installed valve seal disposed between the two valve guide sections.

BACKGROUND OF THE INVENTION

In conventional overhead valve internal combustion engines at least two valves reciprocate to provide intermittent communication between intake and exhaust manifolds and a combustion chamber. The valves have valve stems which are commonly disposed in valve stem guides, supporting axial motion in an engine component such as an engine head. Lubrication is provided to upper portions of the valve stems by a spray of lubricating oil within a valve cover disposed over the head, or by gravity flow from an associated rocker arm. Oil flows by the force of gravity and may be encouraged by a pressure differential in the manifold versus crankcase pressure along a free upper end of the valve stem toward the manifolds and valve heads.

Valve guide seals located between the valve stem and the valve guide serve various purposes. First, they minimize engine oil consumption by restricting oil entry into the manifold and the combustion chamber. Second, they help to minimize exhaust particulates which contribute to pollution. Third, they are helpful in minimizing guide wear, which is of particular importance with diesel engines due to the nature of their operation.

Valve stem seals have been commonly located on the upper end of the valve guide. The upper end of the valve guide is distal to the combustion chamber, thereby distancing the seal from the intense heat of the combustion gases. However, despite such heat, the ideal location of a valve stem seal is near the lower end of the valve guide because lubricating oil may then be freely presented to the stem and guide wear surfaces. As a compromise between heat and function, it would be desirable to locate a valve stem seal within the guide, but somewhere above the lower end of the guide where temperature exposure is reduced. Locating a conventional seal in such a location is impossible since it is spaced away from both axial ends of the guide and would be destroyed when the guide is reamed to a final guide bore size, location and finish.

SUMMARY OF THE INVENTION

The present invention is directed to an improved in-guide valve seal assembly received in an axially extending bore of an internal combustion engine. The assembly includes two discrete valve stem guide sections with a valve stem seal disposed between them near the lower end of the guide.

The first guide section is press fitted into the bore of the engine. Next, the seal is inserted into the bore. Then the second valve guide section is inserted into the bore. A gap is formed between inner axial surfaces of each of the guide sections which receives the seal in an uncompressed free state. The seal is axially spaced away from at least one of the guide inner axial surfaces. Then the first and second guide sections are reamed to the final and proper diameter and finish. Finally, the guide sections are axially pressed toward each other to place the seal into a final installed orientation. An elastomeric portion of the seal is compressed so that its innermost radial extent engages the outer periphery of an installed valve stem. The seal may include a metallic retainer which engages the inner axial surface of the two guide sections to help prevent seal overloading.

Extremely tight tolerances require the use of a reaming operation after the guide sections are installed into the bore. Only by the use of such an operation can the guide stem hole be properly sized and located. Thus, the use of a seal which will not be destroyed by the reaming process is of particular concern. The seal is also easily customized with the degree of compression controlled by modifying the nature of the elastomeric seal element, the axial and radial extents of the retainer and the like. Thus, oil flow about the seal can be easily adjusted for a particular application.

BRIEF DESCRIPTION OF THE DRAWINGS

The features and inventive aspects of the present invention will become more apparent upon reading the following detailed description, claims, and drawings, of which the following is a brief description:

DETAILED DESCRIPTION OF A PREFERRED EMBODIMENT

Figure 1:
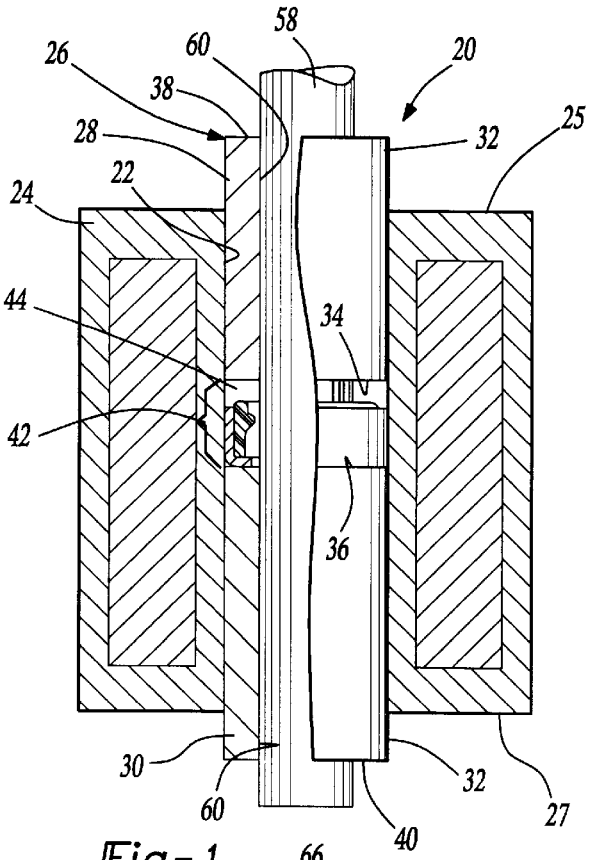
FIG. 1 is a cross-sectional view of a first embodiment of the present invention with a two-piece valve stem guide having a seal disposed between the two sections, one of the sections being axially spaced from the seal and the two sections being reamed.

A valve stem assembly 20 is adapted to be received in an axially extending bore 22 of an internal combustion engine component such as an engine head 24, head 24 including an upper axial surface 25 and a lower axial surface 27.

Valve stem assembly 20 includes an annular two-piece valve stem guide 26 comprising two distinct annular guide sections 28 and 30 . Guide sections 28 and 30 may be formed from powdered metal. Guide sections 28 and 30 share a common outer radial diameter 32 which closely corresponds to the diameter of bore 22 such that when each guide section is press fitted into bore 22 a very tight fit results between the sections and the bore wall. Each guide section includes an inner axial surface 34, 36 and an outer axial surface 38, 40.

Figure 2:
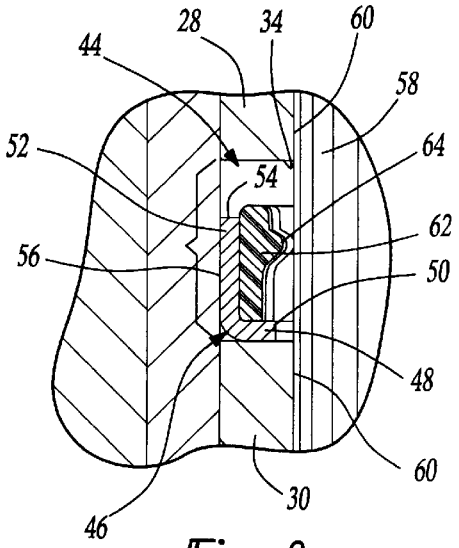
FIG. 2, is an exploded cross-sectional view of the valve stem seal of FIG. 1 showing that the seal is spaced radially away from the reamer.

An axially extending gap 42 exists between inner axial surface 34 of guide section 28 and inner axial surface 36 of guide section 30. Disposed within gap 42 is a valve stem seal 44 in a non-final installed orientation. As best shown in FIG. 2, seal 44 includes a metallic retainer 46 which is generally L-shaped, having a first radially inwardly extending leg 48 terminating at free end 50 and an axially extending leg 52 terminating at a free 54. The axial extent of gap 42 is greater than the axial extent of leg 52. The radial extent of leg 52 is controlled such that it will not intersect a valve stem inserted into assembly 20. Finally, the outer radial diameter 56 of leg 52 generally corresponds to outer radial diameter 32 of guide sections 28 and 30, although it may be slightly less.

Typically, guide section 30 is press-fitted first into bore 22. Then, seal 44 is inserted into bore 22 such that the seal is adjacent the inner axial surface 36. Next, guide section 28 is press fitted into bore 22 such that gap 42 remains. Axial surface 34 is spaced away from free end 54 of seal 44. Both of the valve guide sections 28 and 30 are reamed using a reamer 58 so that the guide sections share a common inner radial diameter 60. To facilitate the reaming operation, guide sections 28 and 30 preferably already include an axially extending bore, but with a diameter less than that required for a valve stem.

As shown in FIGS. 1 and 2, seal 44 includes an elastomeric seal element 62. Seal element 62 is secured to retainer 46 using methods common to the art. Seal element 62 is designed such that when it is in the non-final installed orientation, seal element 62 is in an uncompressed free state extending axially from leg 48 along leg 52 and terminating at a point axially outwardly of free end 50 of leg 48. Similarly, seal element 62 extends radially from leg 52 along leg 48 and terminates at a lip 64 preferably spaced radially outwardly from common inner radial diameter 60 of guide sections 28 and 30. Free end 50 of leg 48 is always spaced radially outwardly from diameter 60. As a result, when guide sections 28 and 30 are reamed, seal 44 is unaffected.

Figure 3:
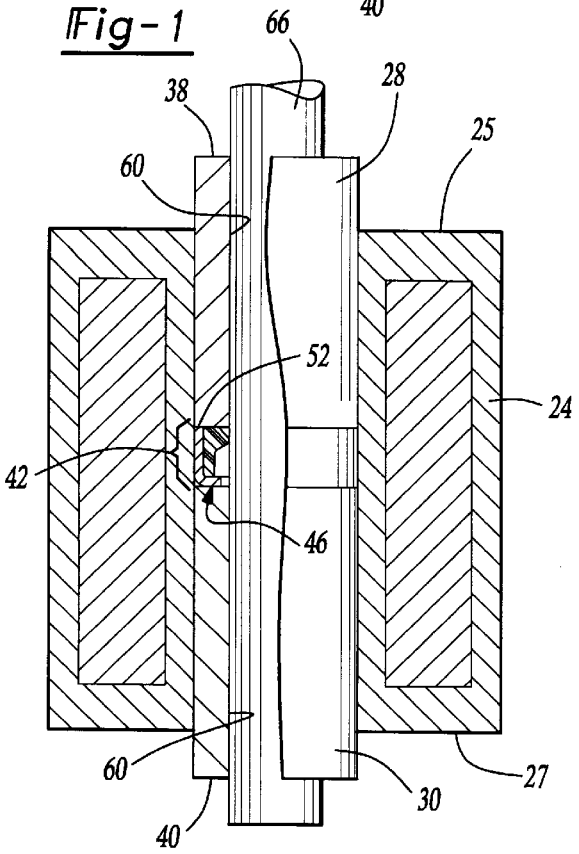
FIG. 3 is a cross-sectional view of the valve stem guide in its final installed position, wherein there is no axial gap between the seal and upper guide section, forcing the seal into radial contact with the valve stem guide.
Figure 4:
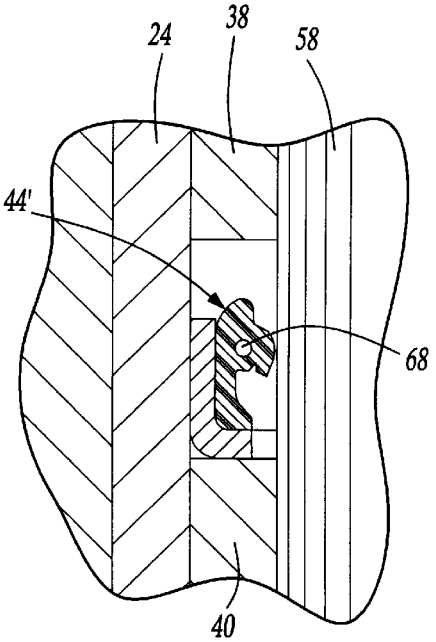
FIG. 4 is a cross-sectional view of a second embodiment of a valve stem guide and seal combination being reamed, wherein the seal includes a spring.

As illustrated in FIG. 3, once guide sections 28 and 30 are reamed to form diameter 60, the guide sections are forced together axially. As guide sections 28 and 30 are forced toward each other, gap 42 is reduced in size so it corresponds to the axial extent of retainer leg 52 with axial inner surfaces 34 and 36 of the guide sections in facial contact with leg 52 of retainer 46. Leg 52 helps to prevent over-compression or overloading of elastomeric seal element 62 by limiting the axial travel of the two guide sections.

Preferably, guide section 30 is already in its final axial position. Therefore, it is guide section 28 which is pressed axially inwardly to engage retainer 46. Yet, even in the final installed orientation, both outer axial surfaces 38 and 40 extend outwardly of surfaces 25 and 27, respectively, of engine component 24, thereby allowing additional adjustments to gap 42 and seal 44 if necessary.

An alternative embodiment of seal 44, seal 44' is illustrated in FIG. 5. Seal 44' includes an annular spring 68, but functions in generally the same way as seal 44 with respect to its use in assembly 20.

The present invention provides a number of advantages. Most significantly, the axial extents of valve guide sections 28 and 30 may be customized to place seal 44 as close as possible to the lower end of valve guide 26 while still distancing the seal from the intense heat of the combustion gases to the extent required by a particular application. Thus, oil consumption is minimized by restricting oil entry into the manifold and the combustion chamber. At the same time, however, by having seal 44 located near the lower end of valve guide 26 helps to maximize the lubricating oil which may be freely presented to the stem and guide wear surfaces.

Through the inventive design extremely tight tolerances are still possible through the use of a reaming operation after guide sections 28 and 30 are installed into bore 22, giving the guide stem hole a proper size, location, and finish. Seal 44 is unaffected by the reaming operation. Once the operation is completed, seal 44 may be customized with the degree of compression controlled by modifying the nature of elastomeric seal element 62, the axial and radial extents of retainer 46 or through the use of spring 68. Thus, oil flow about seal 44 can be adjusted for a particular application to ensure that adequate lubrication is maintained with the minimum amount of oil.

The disclosed embodiments and examples are given to illustrate the present invention. However, they are not meant to limit the scope and spirit of the present invention. Therefore, the present invention should be limited only by the appended claims.

What is claimed is:

1. A valve stem guide assembly comprising:

two discrete axially extending valve stem guide sections, each section including outer and inner axial end surfaces and a substantially constant and equivalent outer and inner radial diameter, said inner axial end surfaces spaced from one another; and a valve stem seal, said seal disposed between said inner axial end surfaces of said guide sections.

2. A valve stem guide assembly as recited in claim 1, wherein each of said guide sections share a common outer radial diameter.

3. A valve stem guide assembly as recited in claim 1, wherein said seal includes a retainer, said retainer defining an axial extent between said inner axial end surfaces of said guide sections such that each axial end of said retainer is in contact with one of said guide sections when said assembly is in a final installed orientation.

4. A valve stem guide assembly as recited in claim 3, wherein said seal includes an elastomeric portion, said elastomeric portion terminating at a radial extent equal to or spaced outwardly of said common inner radial diameter of said guide sections and extending axially outwardly of one of said axial ends of said retainer when said seal is in a non-final installed orientation.

5. A valve stem guide assembly as recited in claim 4, wherein said elastomeric portion of said seal is compressed to terminate at a radial extent equal to or slightly radially inwardly of said common inner radial diameter of said guide sections and to terminate at an axial extent equal to a corresponding axial extent of said retainer when said seal is in said final installed orientation.

6. A valve stem guide assembly as recited in claim 5, wherein said elastomeric portion of said seal includes a lip, said lip defining said radial innermost extent of said elastomeric portion and adapted to contact a valve stem.

7. A valve stem guide assembly as recited in claim 5, wherein a generally annular spring is disposed within said elastomeric portion.

8. A valve stem guide assembly as recited in claim 3, wherein said retainer is generally L-shaped in cross-section, a first leg defining said axial extent of said retainer, and a second leg extending radially inwardly but spaced radially outwardly of said common inner radial diameter of said guide sections.

9. A valve stem guide assembly as recited in claim 2, wherein said guide sections are formed from powdered metal.

10. A valve stem guide assembly as recited in claim 1, wherein said guide sections include a common outer radial diameter and are press-fitted into a bore formed in an engine component receiving said assembly.

11. A valve stem guide assembly received in an axially extending bore of an internal combustion engine component, comprising:

two discrete axially extending valve stem guide sections having common inner and outer radial diameters press fitted into the bore of said component, each section including outer and inner axial end surfaces, said inner axial end surfaces spaced from one another, and a valve stem seal, said seal disposed between said inner axial end surfaces of said guide sections, said seal including a retainer, wherein said retainer and each of said guide sections share said common outer radial diameter, said retainer including an elastomeric portion, said elastomeric portion extending axially outwardly of one of axial ends of said retainer when said seal is in a non-final installed orientation, and wherein said retainer defines an axial extent between said inner axial end surfaces of said guide sections such that each axial end of said retainer is in contact with one of said guide sections and said elastomeric portion of said seal is compressed to terminate at a radial extent at least equal to said radial extent of said common inner radial diameter of said guide sections and one of said axial ends of said retainer, when said seal assembly is in a final installed orientation.

12. A valve stem guide assembly as recited in claim 11, wherein said retainer is generally L-shaped in cross-section, a first leg defining said axial extent of said retainer, and a second leg extending radially inwardly, but spaced radially outwardly of said common inner radial diameter of said guide sections.

13. A valve stem guide assembly as recited in claim 11, wherein said elastomeric portion of said seal includes a lip, said lip defining said radial innermost extent of said elastomeric portion and adapted to contact a valve stem.

* * * * *